United States Patent [19]

Boulton

[11] 4,303,153

[45] Dec. 1, 1981

[54] INSULATED CARRYING CONTAINER FOR BEVERAGE CONTAINERS

[76] Inventor: Gale E. Boulton, 16306 Sierra Trail, Hacienda Heights, Calif. 91745

[21] Appl. No.: 97,141

[22] Filed: Nov. 26, 1979

[51] Int. Cl.[3] ..... B65D 25/00

[52] U.S. Cl. ..... 206/45.31; 206/139; 206/203; 206/213.1; 206/435; 206/216; 206/429; 206/433

[58] Field of Search ..... 206/429, 427, 433, 434, 206/435, 45.31, 139, 523, 213.1, 203, 216

[56] References Cited

U.S. PATENT DOCUMENTS

| | | | |
|---|---|---|---|
| 1,679,923 | 8/1928 | Tanner | 206/45.3 |
| 2,354,098 | 7/1944 | Bamber | 206/45.31 |
| 2,690,839 | 10/1954 | Robinson | 206/434 |
| 2,911,136 | 11/1959 | Stone | 206/427 |
| 3,042,194 | 7/1962 | Champlin | 206/427 |
| 3,696,990 | 10/1972 | Denhurst | 206/427 |
| 3,904,036 | 9/1975 | Forrer | 206/427 |
| 3,949,876 | 4/1976 | Bridges et al. | 206/427 |
| 4,096,985 | 6/1978 | Wood | 206/427 |
| 4,149,636 | 4/1979 | Pintsak et al. | 206/434 |
| 4,202,446 | 5/1980 | Sutherland | 206/427 |

FOREIGN PATENT DOCUMENTS

| | | | |
|---|---|---|---|
| 1552219 | 9/1979 | United Kingdom | 206/433 |

*Primary Examiner*—Joseph Man-Fu Moy
*Attorney, Agent, or Firm*—Jack C. Munro

[57] ABSTRACT

A thermally insulated carrying container for an assembled plurality of beverage containers which is constructed entirely of a thin sheet plastic foam material. The carrying container is to include side flaps which are to be locatable in an open position to facilitate refrigeration and visibility of the beverage containers and also being movable to a lockable closed position so as to maintain the beverage condition cold for a substantial period of time. A handle means is provided to facilitate carrying of the container. A latching means is provided between the openable top of the carrying container and the bottom of the carrying container to maintain an enclosure of the carrying container when desired.

12 Claims, 10 Drawing Figures

INSULATED CARRYING CONTAINER FOR BEVERAGE CONTAINERS

BACKGROUND OF THE INVENTION

The field of this invention relates to packages, and more particularly to a particular type of package for an assembled grouping of beverage containers such as is frequently termed a "six-pack". It is well known that beverage containers, such as cans or bottles, are marketed in a convenient quantity, such as an assembled grouping of six. This grouping of six beverage containers is normally connected together with some type of packaging to facilitate shipping, storage, purchase and usage.

The most common types of packaging comprise either a plastic encasement such as a cellophane type of plastic, or takes the form of paper, which is folded and constructed so as to facilitate carrying.

Such groupings of beverage containers are frequently utilized by consumers on picnics, at the beach, on golf courses, and so forth. It is obviously desirable to keep the beverages cold. The normal method of maintaining this colder temperature is to employ the use of a separate ice chest. This ice chest is to be loaded with a quantity of the beverage containers and a quantity of ice is located within the ice chest. Such an arrrangement will keep the beverages cold for as long as the ice lasts.

However, the above method does require the use of a separate container, that being the ice chest, and also requires the acquiring of a quantity of ice. Usually ice chests are rather large and bulky and are not convenient to use, as well as sometimes being quite heavy. Additionally, it may be desirable to only maintain beverages at a colder temperature for a short period of time, such as two or three hours.

Previous to this invention, there has been no known construction of a packaging assembly for a six-pack of beverage containers in which the packaging itself was insulated so as to keep the beverages cold for a short period of time, such as two to three hours. Such a packaging assembly would be most desirable so that beverage containers could be readily carried on golf carts, to the beach, on picnics, etc., without the use of an ice chest.

SUMMARY OF THE INVENTION

The structure of this invention relates to a packaging assembly for an assembled group of beverage containers. This packaging assembly includes a bottom and a top which is movable in respect to the bottom. The bottom includes an encased section. The entire packaging container of this invention is constructed of a thermally insulative material, such as a thin sheet plastic foam. The bottom and top cooperate together with a pair of flaps to form a handle which is to facilitate carrying of the container. The top includes a pair of side flaps which are to be movable from a position in abutting engagement with the undersurface of the top to a second position substantially perpendicular to the top. With the side flaps in the second position, they are to lockingly engage with the bottom, thereby completely enclosing the encased section. The carrying container may include aligned recesses for the beverage container so as to prevent banging together of the beverage containers during shipping and carrying.

The primary objective of this invention is to construct a packaging assembly for a given quantity of beverage containers which is thermally insulative, and which will keep the contained beverages cold (or hot) for a substantial period of time.

Another objective of this invention is to construct a thermally insulative carrying container which can be manufactured most inexpensively so as to permit disposal of the carrying container after a single usage.

Another objective of this invention is to incorporate within the carrying container separate pockets so as to maintain each beverage container within a prescribed area so as to prevent banging together of the containers during shipping and usage, and so as to prevent breaking if the beverage container happens to be glass.

DETAILED DESCRIPTION OF THE SHOWN EMBODIMENT

Figure 1:
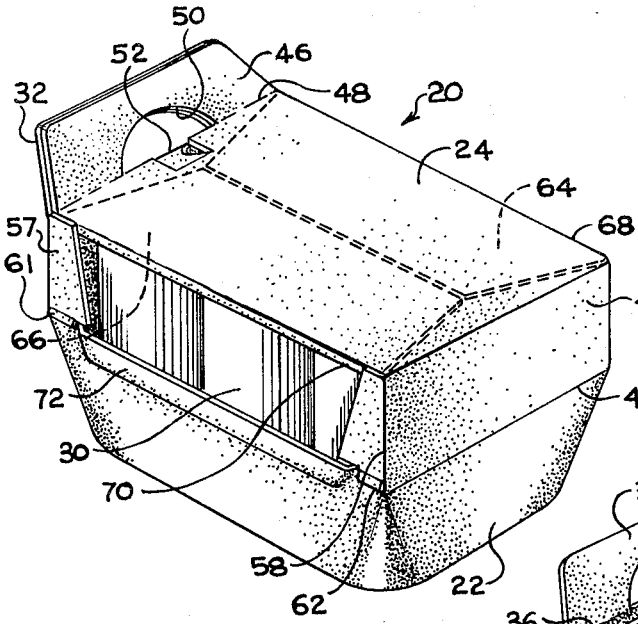
FIG. 1 is a perspective view of the first embodiment of carrying container of this invention in the normally refrigerated position, this embodiment of carrying container being designed in particular to support cans.
Figure 2:
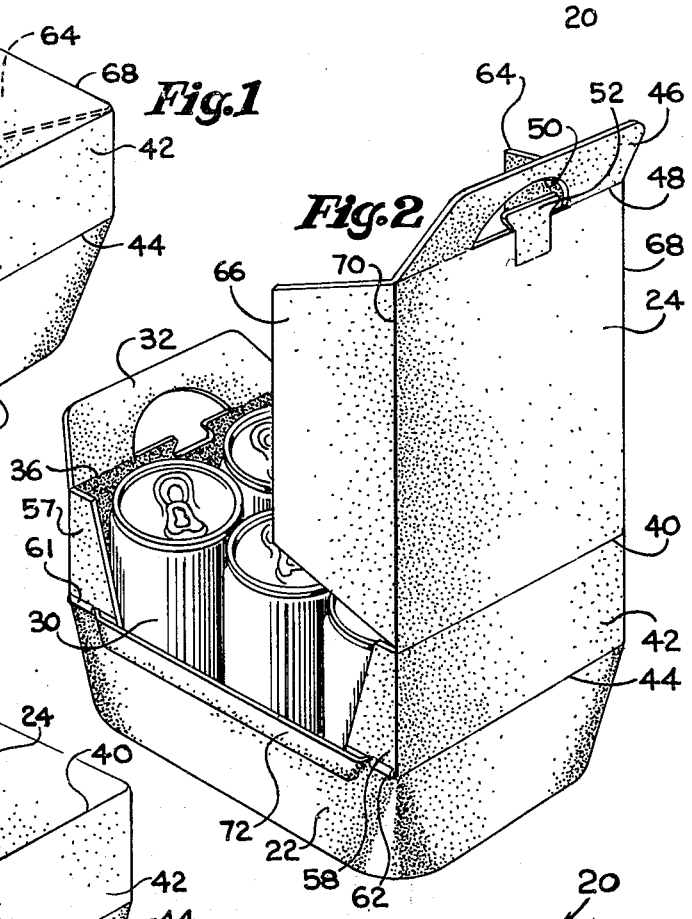
FIG. 2 is a perspective view similar to FIG. 1, but with the top in an open position to facilitate entry into the encased section of the carrying container to remove one or more of the beverage cans.

Referring particularly to the drawings, there is shown in FIGS. 1-4 the first embodiment 20 of the carrying container of this invention. The carrying container 20 is to be constructed of an insulative plastic foam, sheet material. Basically, the carrying container 20 is composed of a bottom 22 and a top 24. The bottom 22 includes a plurality of upstanding side walls which are connected together forming an encased section 26. The substantially planar bottom section of the bottom 22 includes interiorly a plurality of spaced apart recesses 28. Each recess 28 is to accommodate a single beverage container 30. The type of beverage container 30 is what is termed a can with such cans being in most common use. There are to be six in number of the cans 30 located within the carrying container 20.

The bottom 22 has attached thereto at a forward edge thereof an attaching flap 32. The attaching flap 32 is movable with respect to the bottom 22 with there being a score line 34 created between the flap 32 and the forwardmost edge of the bottom 22. A similar score line 36 is located within the attaching flap 32 which provides for the outermost section of the attaching flap 32 being movable within respect to the remaining portion of the attaching flap 32. Also with in the attaching flap 32 is located an irregularly shaped opening 38.

The top 24 is attached at its back edge thereof at a score line 40 to an extending section 42. The extending section 42 is integrally attached at the score line 44 to the aft edge of the bottom 22. The top 24 and the extension 42 are movable to the position shown within FIGS. 2 and 4 of the drawings in order to gain access into the encased section 26. Also, the top 24 is to be moved to the covering position shown within FIG. 1.

Figure 3:
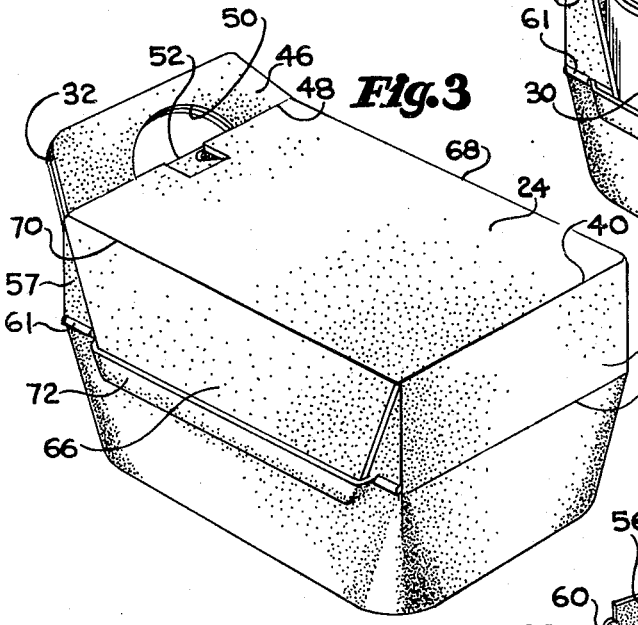
FIG. 3 is a perspective view similar to FIG. 1, but showing the carrying container completely enclosed to maintain the beverages cold.
Figure 4:
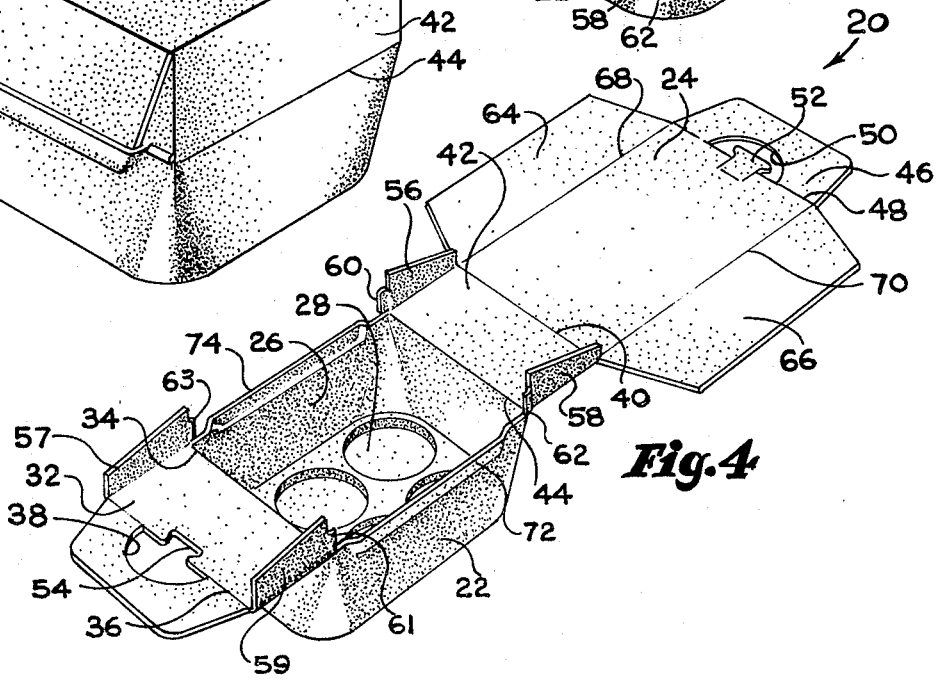
FIG. 4 is an entirely open perspective view showing the carrying container of this invention empty.
Figures 5, 6, 7, 8, 9, 10:
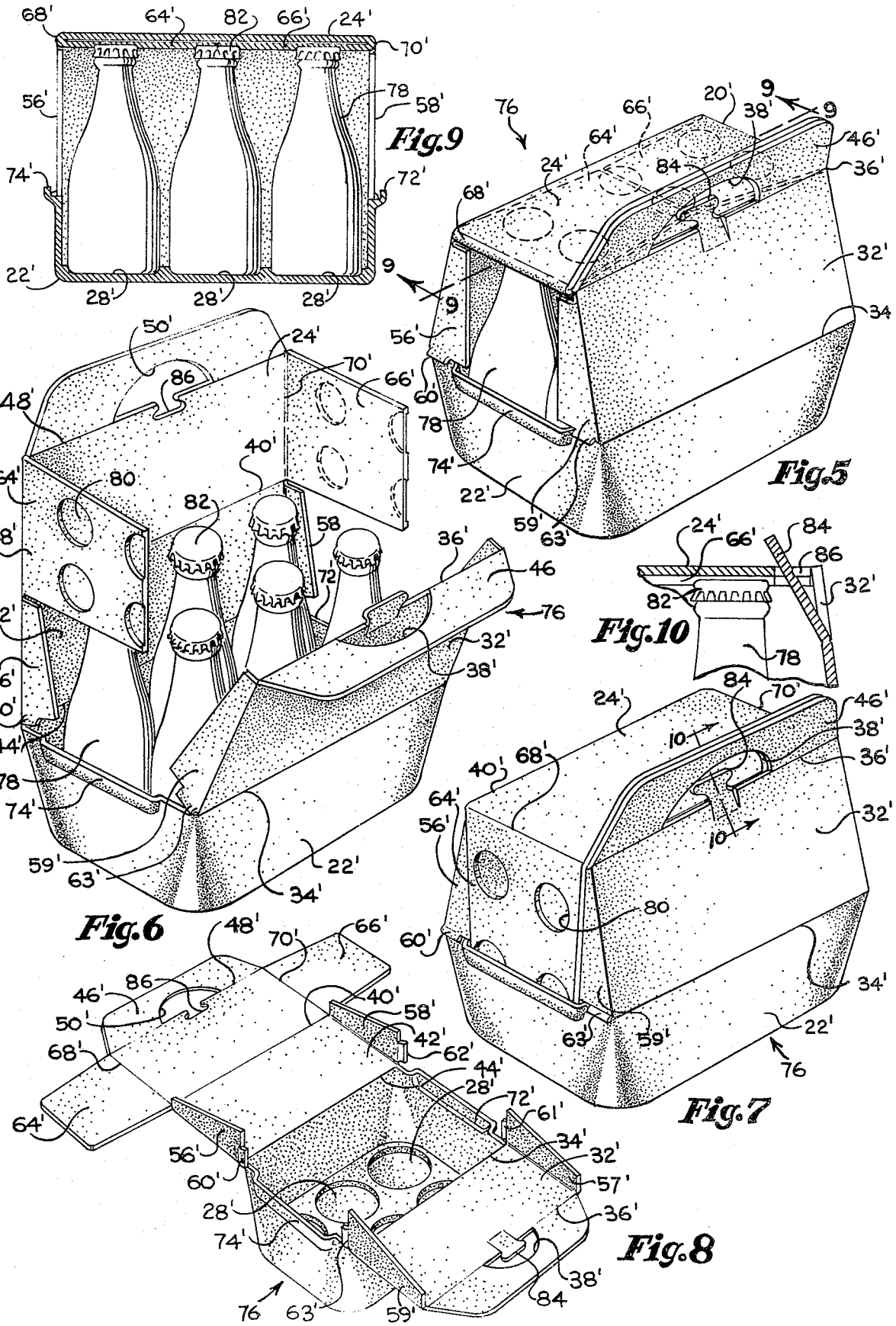
FIG. 5 is a perspective view of a second embodiment of carrying container of this invention which is designed in particular for bottles, showing the carrying container in its normally refrigerated position.
FIG. 6 is a perspective view of the carrying container of FIG. 5 showing the top in an open position in order to gain access into the carrying container.
FIG. 7 is a perspective view of the carrying container of FIG. 5 showing the carrying container in a completely enclosed position.
FIG. 8 is a view similar to FIG. 4, but with respect to the embodiment of carrying container of FIG. 5.
FIG. 9 is a cross-sectional view through the second embodiment of the carrying container of this invention taken along line 9—9 of FIG. 5.
FIG. 10 is a cross-sectional view through the latching assemblage within the second embodiment of this invention taken along line 10—10 of FIG. 7.

The outermost edge of the top 24 includes an attaching flap 46. This attaching flap 46 is movable with respect to the top 24 by means of a score line 48. With the top 24 in the covered position shown in FIG. 1, the attaching flap 46 is in abutting engagement with the outermost section of the flap 32 as shown in FIGS. 1 and 3 of the drawings. Also, when in this position, there is an irregular shaped opening 50 which is similar in size to the irregular shaped opening 38. With the attaching flap 46 in contact with the outermost section of the flap 32, the openings 50 and 38 coincide and cooperate together to permit entry of a person's finger in order to facilitate grasping of the carring container 20.

Also formed within the top 24 and extending within the irregular shaped opening 50 is a protuberance 52. The protuberance 52 is to be movable by appropriate score lines with respect to the top 24 and is to latchingly engage with portion 54 of the irregular shaped opening 38. This is to securely connect together the carrying container 20 when in the partially or completely closed position shown respectively in either FIGS. 1 or 3 of the drawing.

An extension 42 includes small side flaps 56 and 58. The side flaps 56 and 58 are located parallel to each other and are fixedly mounted at a right angle with respect to the extension 42. Side flap 56 also includes a tab 60 with the side flap 58 including a similar tab 62. The tabs 60 and 62 are to extend exteriorly over the upper edges of the bottom 22 when the extension 42 is in the position shown in FIGS. 1, 2 and 3 of the drawings.

The attaching flap 32 also includes side flaps 57 and 59. Side flaps 57 and 59 include respectively locking tabs 61 and 63. Locking tabs 61 and 63 are to connect with the upper edge of the bottom 22 in the manner similar to locking tabs 60 and 62.

The top 24 includes at its lateral edge thereof, side flaps 64 and 66. Side flap 64 is movable by means of a score line 68 with respect to the top 24. A similar score line 70 permits movement of flap 66 with respect to the top 24. The flaps 64 and 66 can be located in abutting engagement with the underside of the top 24 as shown in FIG. 1 of the drawings. The flaps 64 and 66 will normally be in this position when the carrying container 20 is being refrigerated so as to permit refrigerated air to be conducted into contact with the beverage containers 30. Upon a person removing the carrying container 20 from the refrigerated environment, the person would then normally desire to maintain the cold temperature of the beverage containers. At this particular time, the person will disengage the protuberance 52 from the opening 54 and move the top 24 to the position shown in FIG. 2 of the drawings. The person then moves the flaps 64 and 66 to a substantially perpendicular position with respect to the top 24. The person then relocates the top 24 on top of the beverage containers 30. While doing so, the person locates the flap 66 in the recess section provided by an elongated protruding section 72. A similar elongated protruding section 74 is provided for the flap 64. The protruding section 74 causes the flaps 64 and 66 to be closed tightly about the sides of the carrying container 20 and results in the carrying container 20 to be completely enclosed, not permittig ready access of the ambient air into the encased section 26. As a result, beverage containers 30 will be caused to remain refrigerated for a reasonable length of time, such as two to three hours, or longer.

Referring particularly to FIGS. 5–10 of the drawings, there is shown a second embodiment of carrying container 76 which is designed particularly for the bottle type 78 of beverage container. In order to avoid duplication of description, like numerals have been employed to refer to like parts in reference to FIGS. 1 and 4. The numerals are altered slightly in FIGS. 5–10 by being referred to as a prime. The description applicable to FIGS. 1–4 in regard to similar numerals is to be applicable to the structure of FIGS. 5–10 and reference is to be had thereto.

The primary distinction of FIGS. 5–10 relates to the inclusion of recesses 80 located within the flaps 68' and 66'. Each recess 80 is to connect with a cap 82 of a separate beverage container 78. This additional recess within the flap 66' and 68' is deemed to be necessary in order to prevent the upper portion of the beverage containers 78 from moving into contact with each other during shipping and carrying of the carrying container 76.

Another distinction of the embodiment of FIGS. 5–10 is that the latching protuberance 84 is located in the irregular shaped opening 38' which is the reverse of FIGS. 1–4. Also, the latching recess 86 is formed as part of the irregular shaped opening 50' which is again the reverse of FIGS. 1–4. Otherwise, the embodiment of FIGS. 5–10 operates in precisely the same manner as the embodiment of FIGS. 1–4 and the foregoing description regarding the operation of FIGS. 1–4 is deemed to be also applicable to the carrying container 76. The material of construction of the carrying container 76 is to be identical to the material of construction of the carrying container 20.

What is claimed is:

1. A thermally insulated carrying container for an assembled plurality of beverage containers, said carrying container being constructed substantially entirely of a thin plastic foam sheet material, said carrying container comprising:

a bottom and a top, said bottom forming an encasing section adapted to receive a number of beverage containers, said top being movable in respect to said bottom between an open position providing access into said encasing section and a closed position covering said encasing section, said top having a front and a back edge interconnected by side edges, said back edge being attached to said bottom; and a separate side flap attached to each said side edge, each said flap being movable in respect to said top back and forth between a first position and a second position, said first position connecting each said flap with said bottom thereby forming a totally enclosed container when said top is in said closed position thereby not exposing said enclosed section to the ambient, said second position forming enlarged openings into said encasing section exposing said encasing section to the ambient, whereby with said flaps in said second position said carrying container is to be located in a refrigerated environment thereby cooling said beverage container, upon removal of said carrying container from the refrigerated environment the said flaps are moved to said first position to maintain the refrigerated environment in said totally enclosed container.

2. The carrying container of claim 1 including:

handle means connected to said carrying container to facilitate carrying of said container.

3. The carrying container as defined in claim 2 wherein:

said handle means being integrally formed with respect to said carrying container.

4. The carrying container as defined in claim 3 wherein:

said handle means taking the form of a pair of attaching flaps which are to cooperate together in an abutting relationship to function as a single unit, one of said attaching flaps being attached to said bottom with the other of said attaching flaps being secured to said top.

5. The carrying container as defined in claim 1 wherein:

said carrying container being constructed as an entirely integral unit.

6. The carrying container as defined in claim 1 including:

latching means located at said front edge and on said bottom, said latching means for securing said top to said bottom when in said closed position.

7. The carrying container as defined in claim 1 including:

securing means connected to said bottom, said securing means for connecting with said flaps when in said first position to maintain said flaps in said first position.

8. The carrying container as defined in claim 1 including:

said bottom including a plurality of aligned recesses, said aligned recesses being spaced apart, each said recess to accommodate the bottom of a single beverage container.

9. The carrying container as defined in claim 8 including:

said flaps including second aligned recesses, each said second aligned recess to accommodate the top of a beverage container.

10. The carrying container as defined in claim 1 wherein:

said second position of said flaps being with said flaps located against said top.

11. The carrying container as defined in claim 10 wherein:

securing means connected to said bottom, said securing means for connecting with said flaps when in said first position to maintain said flaps in said first position.

12. The carrying container as defined in claim 11 wherein:

latching means located at said front edge and on said bottom, said latching means for securing said top to said bottom.

* * * * *